US006109833A

United States Patent [19]

Savy

[11] Patent Number: 6,109,833

[45] Date of Patent: Aug. 29, 2000

[54] DEVICE FOR TRANSFERRING FLUID BETWEEN EQUIPMENT ON THE SEABED AND A SURFACE UNIT

[75] Inventor: Pierre Antoine Desire Savy, Ecosse, France

[73] Assignee: Coflexip, Paris, France

[21] Appl. No.: 09/127,745

[22] Filed: Aug. 3, 1998

[30] Foreign Application Priority Data

Aug. 1, 1997 [FR] France ..... 97 09892

[51] Int. Cl.[7] ..... F21B 43/013; F16L 1/12

[52] U.S. Cl. ..... 405/195.1; 405/169; 405/171; 405/224.2

[58] Field of Search ..... 405/195.1, 169, 405/223.1, 224, 224.2, 227.3, 227.4, 171; 441/3, 4, 5

[56] References Cited

U.S. PATENT DOCUMENTS

| | | | |
|---|---|---|---|
| 4,650,431 | 3/1987 | Kentosh | 441/4 |
| 4,906,137 | 3/1990 | Maloberti et al. | 405/224.3 |
| 5,505,560 | 4/1996 | Brown et al. . | |
| 5,639,187 | 6/1997 | Mungall et al. | 405/195.1 |

FOREIGN PATENT DOCUMENTS

| | | | |
|---|---|---|---|
| 0251488 | 1/1988 | European Pat. Off. . | |
| 2627542 | 8/1989 | France . | |
| 87/05876 | 10/1987 | WIPO | 441/3 |
| 9722780 | 6/1997 | WIPO . | |

*Primary Examiner*—Eileen Dunn Lillis
*Assistant Examiner*—Frederick L. Lagman
*Attorney, Agent, or Firm*—Ostrolenk, Faber, Gerb & Soffen, LLP

[57] ABSTRACT

A device for transferring fluid between equipment on the seabed and a surface unit. At least one flexible pipe extends in a catenary curve. An intermediate buoyancy and support member associated with the pipe splits the pipe into two parts, an upper part and a lower part. The intermediate member imparts to a region of the upper part a concavity facing the seabed. A yoke on the pipe and a cable from the yoke retain at least one region of the lower part of the pipe. The cable is connected to a fixed member on the seabed for tensioning the lower part of the pipe. The cable and the fixed member impart a bend to the region of the lower part of the pipe, the concavity of which faces the equipment on the seabed. The intermediate member is connected to the fixed member. The cable between the lower part of the pipe and the fixed member has a length at least equal to the minimum bend radius of the lower part of the flexible pipe.

10 Claims, 2 Drawing Sheets

DEVICE FOR TRANSFERRING FLUID BETWEEN EQUIPMENT ON THE SEABED AND A SURFACE UNIT

Figure 1:
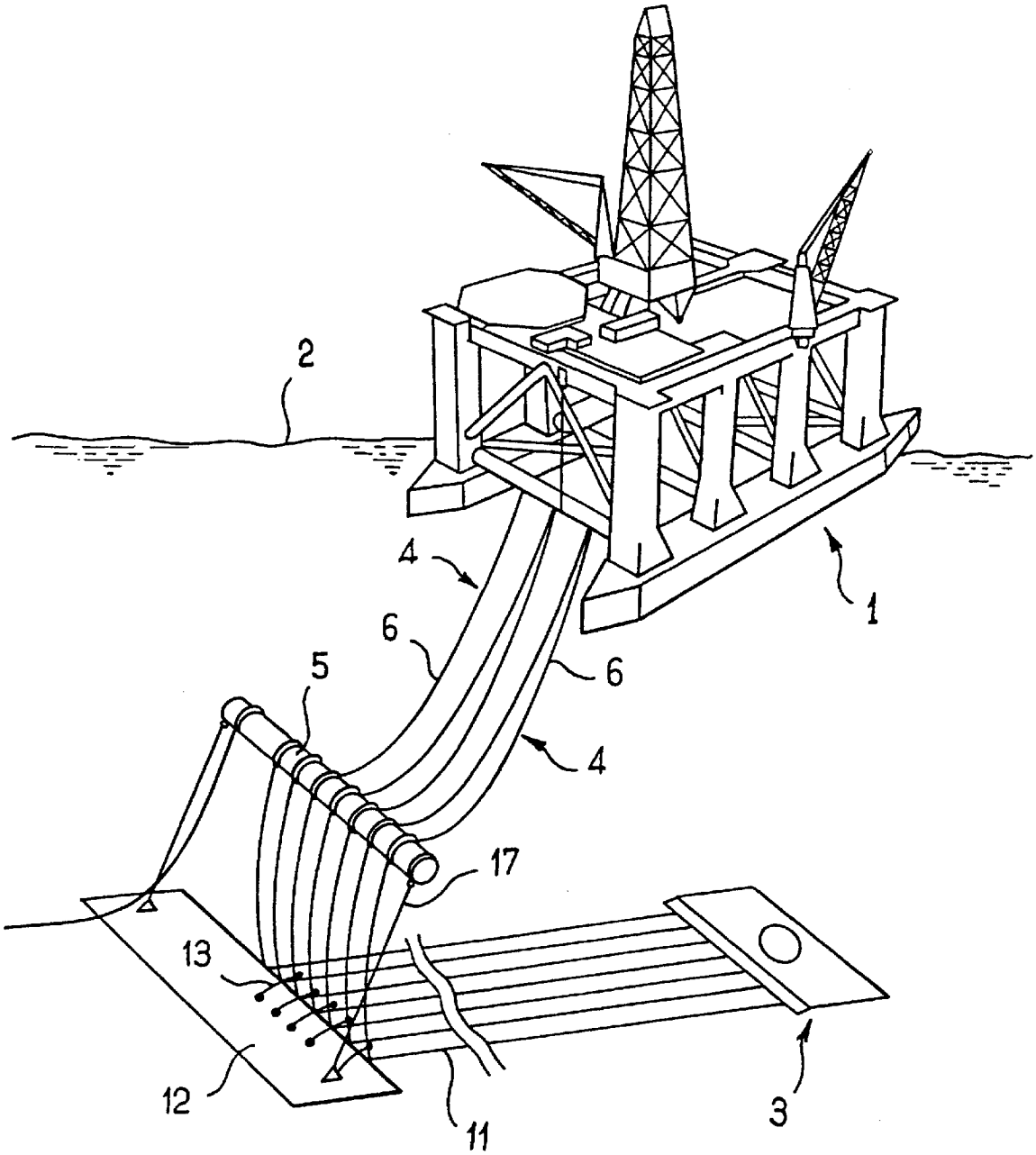

The present invention relates to a device for transferring fluid between equipment on the seabed, such as a wellhead, for example, and a surface unit which may consist of a floating platform or vessel.

In oil production in particular, one or more flexible pipes are used to bring a crude fluid, such as oil, from one or more wellheads and/or a manifold on the seabed up to a surface unit.

Various configurations of the device and of the methods have been and are proposed by the applicant company in a brochure entitled "Dynamic Flexible Risers", published in September 1985, which configurations are also represented in a document entitled "Recommended Practice for Flexible Pipe" (API Recommended Practice 17B, First Edition, Jun. 1, 1988).

The main configurations are those known by the names of "LAZY S", "LAZY WAVE", "STEEP S", "STEEP WAVE". In each of these configurations, the flexible pipe or pipes connecting the seabed equipment to the surface unit are associated with intermediate members which are means with positive buoyancy and thus consist of float buoys or an arch, which intermediate members split each flexible pipe into two parts—an upper part and a lower part—and confer upon the upper part a concavity facing the surface unit.

A significant improvement has been proposed by the applicant in FR-A-2,627,542, the improvement consisting in mounting, on the lower part of the flexible pipe, retaining means which are connected to a fixed point on the seabed and which confer upon said lower part a concavity facing the wellhead and/or the connection assemblies (manifolds), so that a region of said lower part has a mean bend. The content of this document is incorporated into this application in respect of anything relating to the parts which are common, similar, or equivalent.

U.S. Pat. No. 5,505,560 relates to a system for transferring fluid comprising two intermediate members—an upper member and a lower member—splitting the flexible pipe into three parts, an upper part, a region of which has a concavity facing the surface unit, an intermediate part situated between the two intermediate members and having a region in which the concavity also faces the surface unit, and a lower part one region of which has a concavity facing the seabed, the free end of the lower part being connected to the seabed equipment. The upper intermediate member consists of an arch which is connected by a connecting cable to a fixed point on the seabed, while the lower intermediate member consists of float buoys arranged around the flexible pipe. This is, in fact, a combination of the "LAZY S" and "LAZY WAVE" configurations.

EP Application 0 251 488 describes a method for installing a fluid-transfer system, and the transfer system that can be used for implementing the method. The method consists in providing an intermediate member placed laterally with respect to a line that extends vertically from the surface unit, in lowering a flexible pipe from the surface to attach it to the intermediate member, so as to transfer the weight of the lower part of the pipe to the intermediate member.

All the configurations of the prior art were designed and are used for water depths of several hundreds of meters. When the seabed equipment is located in shallow water offshore oil production fields, the flexible pipe and the associated elements may be subjected to very high hydrodynamic loadings or dynamic stresses.

In addition, because of the amplitude of the repeated movement of the flexible pipe, the risk of damage and of early dynamic aging of the flexible pipe is not insignificant. In a cluttered environment containing numerous flexible pipes, umbilicals and connecting cables, such as tethering cables, nearby pipes may bang together which because dynamic stresses applied thereon, cause possible damage to said pipes and/or connecting or tethering cables.

At the outset, it is important to note that a flexible pipe must not be deformed mainly in bending excessively, said maximum permissible deformation for a pipe being expressed by what is known as the minimum bend radius or MBR.

The MBR is the minimum bend radius that the flexible pipe can accept without damage. Excessive bending may lead to damage which may adopt a number of forms described in the API document to which reference can be made.

In shallow water, generally of a depth of less than 100 meters, the heaving movements give rise to vertical and horizontal movements of the surface unit. A sea is considered to be shallow when the amplitudes of the horizontal and/or vertical displacements induced by the waves and the heave are not insignificant with respect to water depth. In practical terms, when the amplitudes exceed 10% of the depth, then the sea is considered to be shallow water. In an oil production field in which use is made of a support arch for the flexible pipes or umbilicals, the movements of the surface unit transmit very significant hydrodynamic loadings to the intermediate support element of the flexible pipe or pipes. One consequence of these hydrodynamic loadings is, among other things, significant horizontal movements of said arch, which results in a dynamic deformation of the flexible pipe. When the surface unit is shifted laterally a long way with respect to the seabed equipment, as is the case in the aforementioned American patent, this entails the use of a very long flexible pipe and therefore a considerable increase in the overall cost of the underwater installation, it being possible for the deformation of the flexible pipe to be more or less absorbed owing to the lengths of flexible pipe used between the surface unit and the intermediate positive buoyancy members on the one hand and between the same intermediate members and the seabed equipment. However, when the surface unit is lying approximately in line with or vertically above the seabed equipment, it will be readily understood that a lateral displacement of the arch and therefore of the flexible pipe will cause significant deformation of this pipe and give it a radius that is smaller than the MBR, with the known consequences.

The object of the present invention is to propose a device for transferring a fluid between equipment on the seabed and a surface unit which can be used irrespective of the distance separating the seabed equipment from the surface unit.

The subject of the present invention is a device of the above type, and comprising at least one flexible pipe extending in a catenary curve, an intermediate buoyancy and support member associated with said pipe and splitting the latter into two parts—an upper part and a lower part—the intermediate member imparting to a region of the upper part a concavity facing the seabed, means for retaining at least one region of the lower part of the pipe, said retaining means being connected by connecting means to a fixed point for tensioning the region lying between the intermediate member and the retaining means, said retaining means and the fixed point imparting to the region lying between the retaining means and the terminal part of the pipe, a mean radius the concavity of which faces the equipment on the seabed, wherein the intermediate member is connected to said fixed point and said connecting means have a length at least equal to the minimum bend radius of the flexible pipe.

One advantage of the present invention lies in the fact that it is particularly beneficial in shallow water oil production.

Another advantage of the present invention lies in the fact that it can be applied to seabed equipment which is laterally shifted with respect to the surface unit or beneath the latter which may consist of a production platform.

Another advantage lies in the fact that the movements of the heave and of the waves cannot excessively deform the flexible pipes or umbilicals connecting the surface unit to the seabed equipment, that is to say that the present invention makes it possible to avoid the bend radius of the deformation being smaller than the MBR at every point along the pipe.

Figures 2, 3:
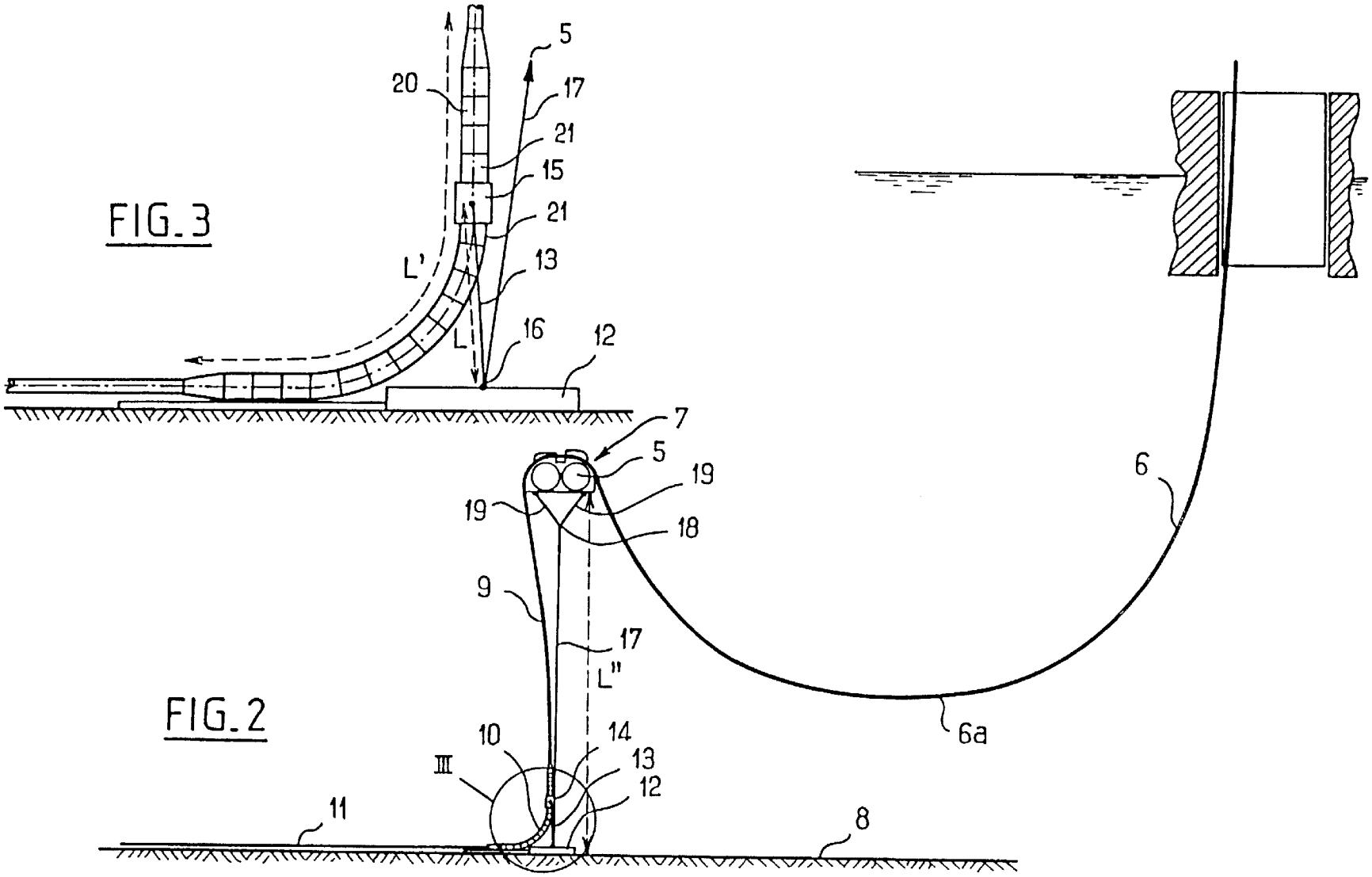

Other features and advantages will become more apparent from reading the description of one preferred embodiment of the invention, and from the appended drawings in which:

FIG. 1 is a perspective view of an oil production assembly comprising a surface unit, seabed equipment and the device according to the invention, FIG. 2 is a diagrammatic depiction of the device according to the invention, FIG. 3 is an enlarged view of the part ringed in FIG. 2.

The device according to the invention is intended to be included in an oil production assembly comprising a surface unit such as a platform 1 kept at the surface of the sea 2, seabed equipment comprising, in particular, one or more wellheads and depicted diagrammatically in FIG. 1 and denoted by the reference 3, flexible pipes and/or umbilicals 4, and an intermediate support and buoyancy member 5.

The support and buoyancy element 5 which consists, for example, of an arch, splits the flexible pipe or pipes and/or umbilicals into at least three parts. In what follows, reference will be made to just one flexible pipe 4 extending as a catenary curve, it being specified that this remains valid for the other flexible pipes and/or umbilicals and, in general, for all elements which are supported by the support and buoyancy element 5. The upper or first part 6 of the flexible pipe lies between the platform 1 and the arch 5 and comprises a region 6*a* the concavity of which faces the surface 2. The second part 7 of the flexible pipe consists of the region resting on the arch 5 and having a concavity facing the seabed 8. The third part 9 lies between the arch 5 and the seabed 8 and comprises a region 10 the concavity of which faces the wellhead 3 which may be situated directly beneath the platform 1 (FIG. 1) or offset laterally and some distance away from said platform 1, the portion of pipe connecting the region 10 to said wellhead being depicted in the left-hand part of FIG. 2, this portion of pipe constituting a fourth part 11 of the flexible pipe.

A deadweight 12 or some other equivalent item of equipment is fixed by any appropriate means to or into the seabed 8.

The third part 9 of the flexible pipe 4 is connected, at least in the portion comprising the region 10, to the deadweight 12, the connection being achieved by means of a cable or tethering line 13 fixed at one end to the deadweight 12 and, at the other end, to a point of attachment 14 of said third part 9. The point of attachment 14 may consist of a yoke 15 clamped around the pipe, it being possible for the yoke 15 to comprise two opposed elements with aligned axes, to each of which a cable or tether 13 is fixed, the two tethers, when used, being fixed to the same tethering point 16 on the deadweight 12.

For a given flexible pipe 4, that is to say for a flexible pipe of known diameter and known structure, the minimum bend radius or MBR is determined. Once this minimum bend radius or MBR is known, the anchoring tether 13 is given a length L such that it is at least equal to said MBR, and this has the effect of limiting the deformation of the region 10 to a certain mean value, greater than the MBR of said pipe, which prevents any irreversible damage of the type mentioned in said API documentation.

Such an embodiment already makes it possible, on the one hand, to align the tension on the pipe with the resultant of the tension on the tether or tethers and, on the other hand, when the pipe is deflected by, for example, crosscurrents, to maintain axial alignment of the pipe on either side of the clamping yoke 15. Thus, the region 10 of the pipe has a mean bend radius that is between two extreme values, the nominal bend radius being determined as a function of the diameter of the pipe and of the conditions of use.

The arch 5 is connected to the deadweight 12 by an anchoring cable or tether 17, one end of which is attached directly to said arch 5 or to a point 18 of connection of two small cables 19 attached to the base of said arch 5, the other end of the anchoring cable 17 being fixed to the deadweight 12 and, preferably, to the anchoring point 16 of the flexible pipe 4.

According to another embodiment of the invention, the region 10 of the third part 9 of the flexible pipe 4 passes through a series of articulated vertebrae 20, said series of vertebrae limiting the maximum amount of bending of said region to a value that can be predetermined. In this case, the clamping yoke 15 may be mounted around part of the series of vertebrae 20 or between two vertebrae 21 of said series 20 and clamped directly around the flexible pipe; as a preference, the clamping yoke 15 is placed approximately at the middle of the length of the series of vertebrae 20. When the minimum bend radius MBR of the flexible pipe 4 is known, the length L' of the series of vertebrae 20 is determined so that it is at least equal to twice and preferably three times said MBR.

As far as the length L" of the anchoring tether for the arch 5 is concerned, it depends on the depth P of water between the surface 2 and the seabed 8, the length L" of the anchoring tether 17 determining the depth of immersion of said arch 5. The length L" is preferably also determined as a function of the amplitude of the movements of the heave and/or the waves likely to occur in the production sector, it being possible for said amplitude to be, for example, of the order of 15 meters and more, and denoted by D. The arch 5 will be immersed at a depth at least equal to D so as to reduce as far as possible the effect of the movements of the sea on said arch 5. As a preference, the depth of immersion of the arch 5 will be between 20 and 70% of the depth P and preferably 50%.

Thus, even with significant heave movements combined with crosscurrents likely to occur in the water, the flexible pipe cannot deform excessively, the deformation produced remaining acceptable around a mean value of the pipe bend radius caused by said deformation.

Thus, and thanks to the present invention, shorter lengths of flexible pipe can be used without the fear of excessive deformation liable to lead to irreversible damage to said flexible pipe when the latter is subjected to hydrodynamic stressing.

What is claimed is:

1. A device for transferring fluid between equipment on a seabed and a surface unit at the surface of that sea, the device comprising:

at least one flexible fluid transferring pipe extending in a catenary curve and between the equipment on the seabed and the surface unit;

an intermediate buoyancy and support member positioned to engage the pipe, and so positioned along the pipe that the pipe includes an upper part between the support member and the surface unit and a lower part between the support member and the equipment on the seabed;

the intermediate member being so shaped and the pipe being so disposed over the intermediate member as to impart to a region of the upper part passing over the intermediate member a concavity that faces the seabed;

a fixed member placeable on or in the seabed;

the intermediate member being connected to the fixed member;

retaining means for retaining at least one region of the lower part of the pipe; connecting elements for connecting the retaining means at the at least one region of the lower part of the pipe with the fixed member for tensioning the lower part of the pipe; the retaining means so retaining the pipe and being so related to the fixed member as to impart to the at least one region of the lower part of the pipe a bend that is concave in the direction toward the equipment on the seabed;

the retaining means comprising a series of vertebrae extending over the region of the lower part of the pipe which has the bend and the series of vertebrae having a length along the pipe at least equal to three times the minimum bend radius of the lower part of the pipe;

the connecting elements between the retaining means and the fixed member having a length at least equal to the minimum bend radius of the lower part of flexible pipe.

2. The device of claim 1, wherein the retaining means for the pipe comprises a yoke clamped around the pipe and the yoke is connected with the connecting elements.

3. The device of claim 2, wherein the yoke is positioned approximately in the middle of the length of the series of vertebrae.

4. The device of claim 3, wherein the vertebrae are spaced along the pipe and the yoke is mounted around the pipe between two of the vertebrae.

5. The device of claim 1, wherein the connection between the intermediate and the fixed member further comprises a tether extending between the intermediate member and the fixed member on the seabed, and the length of the tether is selected to determine the depth to which the intermediate member is immersed.

6. The device of claim 1, wherein when the device is in use in water of a shallow depth, the intermediate member is immersed at a depth of between 20% and 70% of the shallow depth.

7. The device of claim 6, wherein the intermediate member has the form of an arch and the pipe passes over the arch.

8. The device of claim 6, wherein the connection between the intermediate and the fixed member further comprises a tether extending between the intermediate member and the fixed member on the seabed, and the length of the tether is selected to determine the depth to which the intermediate member is immersed.

9. The device of claim 8, where the tether comprises a tethering cable.

10. The device of claim 8, wherein the retaining means to the lower part of the pipe and the tether to the intermediate member are connected to a fixed point on the fixed member.

* * * * *